US005787503A

United States Patent [19]

Murphy, III

[11] Patent Number: 5,787,503

[45] Date of Patent: Aug. 4, 1998

[54] MULTI-LAYER SWEATER

[76] Inventor: Edward J. Murphy, III, 11 Dory La., Massapequa, N.Y. 11758

[21] Appl. No.: 707,425

[22] Filed: Sep. 4, 1996

[51] Int. Cl.[6] ..... A41D 1/04

[52] U.S. Cl. ..... 2/90; 66/196; 66/171

[58] Field of Search ..... 2/90, 239, 159; 66/196, 169 R, 171, 202

[56] References Cited

U.S. PATENT DOCUMENTS

| | | | |
|---|---|---|---|
| 709,734 | 9/1902 | Bellis . | |
| 853,667 | 5/1907 | Williams . | |
| 1,118,062 | 11/1914 | Scott . | |
| 2,263,544 | 11/1941 | Rosenstein | 2/90 |
| 2,741,108 | 4/1956 | Rogosin . | |
| 2,921,456 | 1/1960 | Evans | 66/196 X |
| 2,921,457 | 1/1960 | Evans | 66/196 X |
| 3,108,284 | 10/1963 | Reed | 2/90 X |
| 3,307,379 | 3/1967 | Woolley et al. . | |
| 3,579,766 | 5/1971 | Feinberg . | |
| 3,602,914 | 9/1971 | Castello . | |
| 3,656,323 | 4/1972 | Brown | 66/196 X |
| 4,571,960 | 2/1986 | Hursh et al. | 66/196 |
| 4,733,546 | 3/1988 | Toda . | |
| 4,783,858 | 11/1988 | Chevalier | 2/90 |
| 5,095,548 | 3/1992 | Chesebro, Jr. . | |
| 5,319,807 | 6/1994 | Brier . | |
| 5,373,713 | 12/1994 | Miller . | |

*Primary Examiner*—C. D. Crowder
*Assistant Examiner*—Shirra L. Jenkins
*Attorney, Agent, or Firm*—Collard & Roe, P.C.

[57] ABSTRACT

A double layer sweater which is knit simultaneously of two independent layers, one being an inner layer, and the other layer being an outer layer. Joining the two layers together is a polygonal-shaped quilting stitch pattern forming insulating pockets between the layers. Each layer is different and may be comprised of a blend of wool and acrylic yarn in the outer layer and a synthetic wicking enhanced yarn, such as polyester or acrylic, in the inner layer, such that there is a hydrophilic inner layer and a hydrophobic outer layer. The inner layer is comprised of synthetic yarn with enhanced wicking features. The outer layer of yarn is treated in a bath of teflon material such that the teflon-coated yarn produces the hydrophobic outer layer. The sweater has the properties of insulation to provide warmth to the wearer; has a water repellant and stain resistant outer layer. A wickability inner layer has a capillary action to remove moisture on the skin moving through the inner layer to the outer layer and then evaporated away so that the wearer of the sweater feels dry as well as warm.

10 Claims, 4 Drawing Sheets

FIG. 1
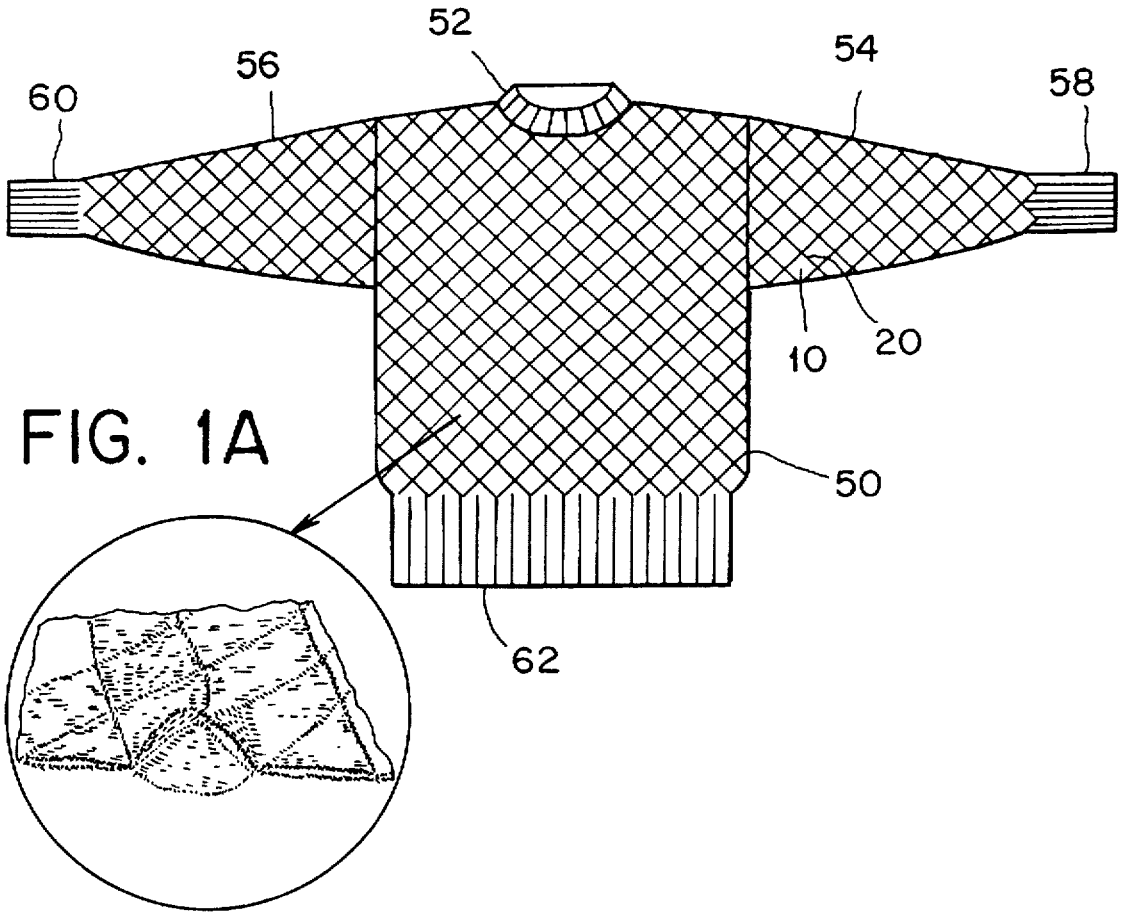
FIG. 1A
FIG. 2A
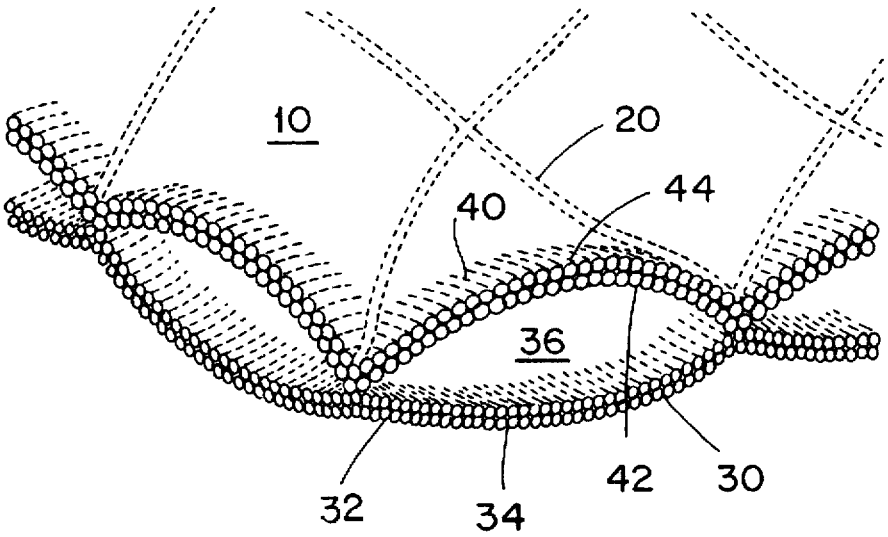

MULTI-LAYER SWEATER

BACKGROUND OF THE INVENTION

1. Field of the Invention

The invention relates to a multi-layer sweater which is knit simultaneously of two independent layers. Each layer is composed of two sets of strands of yarn which may be the same or of different fiber content and construction. In the outer layer, the yarn is treated in a bath of teflon material such that the teflon-coated yarn provides for a water- and stain-resistant exterior. The inner layer of yarn has wickability whereby there is a capillary action along the yarn transporting moisture away from the skin. This action removes perspiration from the skin and through the inner layer to the outer layer, where it is evaporated away into the surrounding air so that the wearer of the sweater feels dry. This sweater also has stitched contiguous polygonal-shaped insulating pockets that join together the separate, independent inner layer and outer layer, whereby these pockets, formed between the independent inner and outer layers, have the property of providing thermal insulation trapping body heat to provide warmth to the wearer.

2. The Prior Art

The Bellis U.S. Pat. No. 709,734, Williams U.S. Pat. No. 853,667, and Scott U.S. Pat. No. 1,118,062 each discloses a knitted fabric comprising two webs, one overlying the other, united at intervals by a loop of the yarn of one web engaging the other web.

Rogosin U.S. Pat. No. 2,741,108 discloses a flame- resistant knitted fabric that can be made by combining synthetic yarns such as saran along with orlon in combination with a cotton layer. Feinberg U.S. Pat. No. 3,579,766 discloses a knitted fabric in which an inner layer is made from a natural fiber such as silk, wool, cotton, or flax, while the outer layer is formed of a synthetic yarn such as nylon, polyamide, Dacron, polyester, polyacrylic, polyethylene, polyurethane, or polyvinylchloride.

Toda U.S. Pat. No. 4,733,546 discloses a knitted fabric that may be made of a multi-layer structure. This patent discloses that it is possible to prepare a fabric composed of mixed yarn consisting of natural fiber and synthetic fiber yarns. It is also possible to produce a knitted fabric having two layers both composed of a non-hygroscopic fiber in which a capillary action between adjacent fibers is created by a means of having the inter-fiber space of the first yarn forming one layer of the fabric made with a different size from the inter-fiber space of the second yarn forming the other layer. Thus, due to this double layer structure of the fabric, sweat secreted from the wearer's skin can be absorbed by the back layer and then transferred to the surface layer by diffusion for evaporation into the open air.

Brier U.S. Pat. No. 5,319,807 discloses a sock having a multi-layer moisture wicking panel. The hydrophilic moisture dispersion yarn resides on an outer surface of the sock away from the skin of the wearer in order to receive and disperse moisture wicked away from the skin by the hydrophobic wicking yarn layer.

Chesbro U.S. Pat. No. 5,095,548 discloses a wicking effect by the appropriate arrangement of hydrophilic yarn layer in combination with a hydrophobic yarn layer.

The following patents are cited as further illustrating state of the art, namely the Wooley U.S. Pat. No. 3,307,379, the Castello U.S. Pat. No. 3,602,914, and the Miller U.S. Pat. No. 5,373,713.

All of the above prior art references have the disadvantage of not providing insulating pockets formed between independent inner and outer layers for warmth and do not provide a water- and stain-resistant exterior for knitted cloth. The prior art references are limited in that they do not provide all three components in this invention, namely a water- and stain-resistent exterior layer to keep the wearer dry from the outside inward; an inner layer comprised of yarn with wickibility features to keep the wearer dry from the inside outward; and, insulating pockets formed between the independent inner and outer layers trapping body heat to provide warmth through insulation to the wearer. The three combined components above will keep the wearer warm, dry and comfortable.

SUMMARY OF THE INVENTION

It is therefore an object of the invention to overcome the drawbacks of the prior art and to provide a multi-layer garment such as a sweater composed of independent layers which keeps the wearer dry due to moisture wickability and water repellency, and which keeps the wearer warm by trapping the body heat of the wearer.

The above object is achieved according to the present invention by providing a multi-layer garment such as a sweater to be worn by a person, which garment has a two yarn end weave wherein each of the yarns is interwoven in an interlocking pattern with the other yarn. These yarns then form a first layer which is made up of a two-yarn end weave and which is also the inner layer of the garment to be placed adjacent to the skin of the person, wherein the inner layer has wickability properties. The garment also has a second layer, which is the outer layer away from the person's skin but adjacent to the first layer and made up of a two-yarn end weave wherein the outer layer has water- and stain-repellant properties. To join these two simultaneously knit independent layers together, the garment has a series of stitching. The stitching forms a series of adjacent contiguous, polygonal-shaped insulating pockets in the multi-layer fabric wherein the stitching joins the inner layer and the outer layer to create a shaped pattern of polygonal-shaped insulating pockets such that the pockets trap body heat between the independent inner and outer layers of the garment to provide substantial warmth for the wearer.

In an additional embodiment of the invention, the multi-layer garment has an inner layer which is made from DuPont's COOLMAX® yarn designed to quickly wick away perspiration from the skin allowing it to evaporate through the cloth keeping the wearer dry and comfortable.

In another embodiment of the invention, the multilayer garment has an outer layer which is made from a wool/acrylic blend of yarn for warmth and breathability and which is treated with Dupont's Teflon HT® to produce a high performance water and stain repellency to provide a water and stain resistant outer layer.

In addition, the present invention provides a multilayer garment to be worn by a person comprising a first layer being an inner layer to be worn adjacent to skin of a person and comprised of a two-yarn weave that has wickability. A second, outer layer is to be worn away from the person and adjacent to the first layer and is comprised of a two-yarn weave. The outer layer is water and stain repellant. There is a series of stitching in a shaped pattern for joining the first layer with said second layer. A series of insulating pockets are formed in said multi-layer garment wherein the stitching joins the first layer with the second layer and creates the pockets in the shaped pattern such that the pockets trap body heat in the garment to provide a greater warmth.

In a further embodiment of the invention, the multi-layer garment has insulating pockets which are shaped like diamonds.

In another embodiment of the invention, the multi-layer garment has insulating pockets which are shaped like circles.

In an additional embodiment of the invention, the multi-layer garment has insulating pockets which are shaped like an ovals.

In a further embodiment of the invention, the multi-layer garment has insulating pockets shaped like a parallelogram.

In another embodiment of the invention the multi-layer garment has insulating pockets which are shaped like a triangle or other polygonal-shaped patterns.

In an additional embodiment of the invention, the multi-layer garment has two strands of yarn in an interlocking pattern formed by a series of loops of yarn.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 1 shows a front view of the multi-layer sweater of the invention;

FIG. 2A shows how each pocket is composed of an arched upper layer and an arched lower layer and each layer is composed of two strands of yarn;

DETAILED DESCRIPTION OF THE PREFERRED EMBODIMENTS

Figure 2:
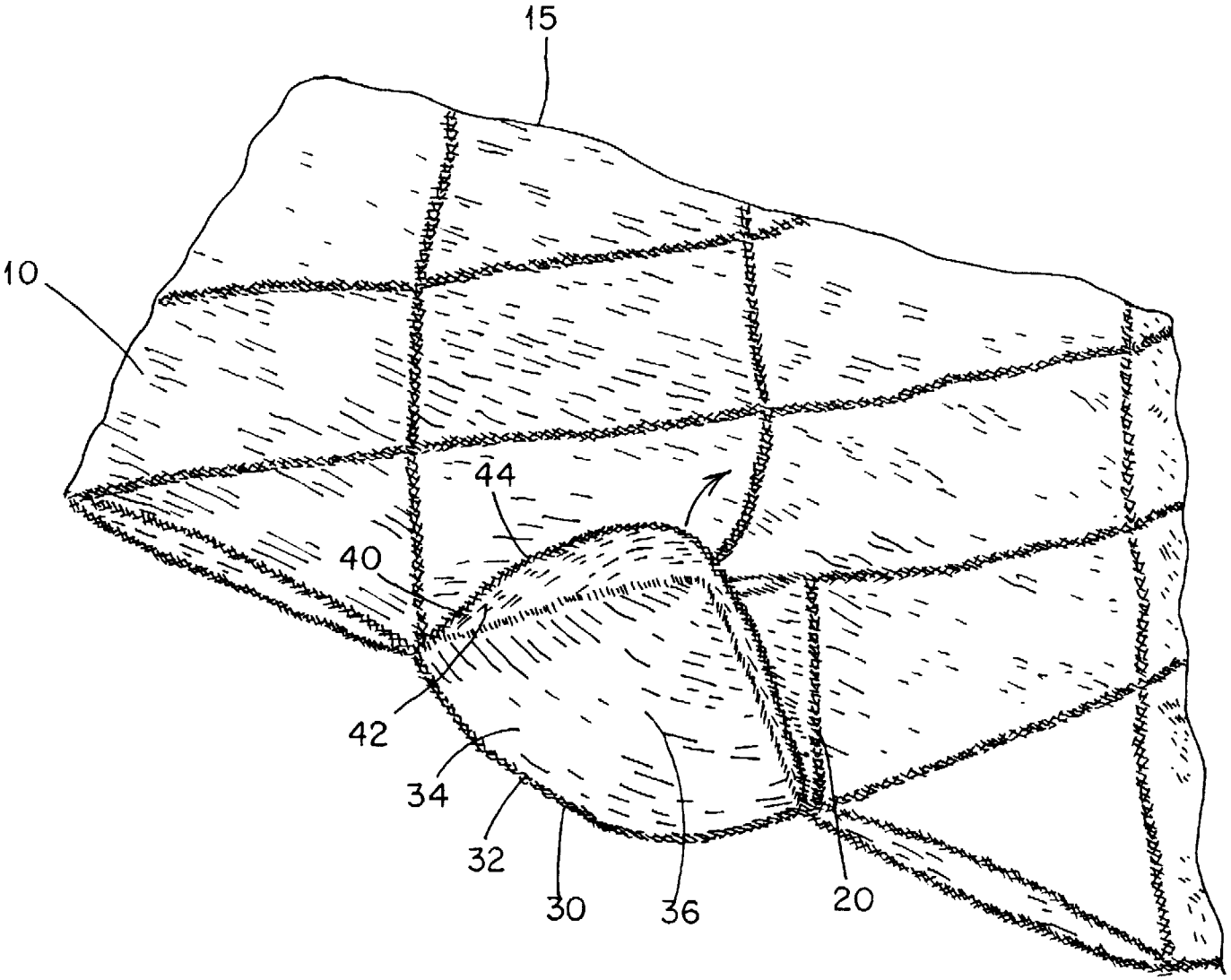
FIG. 2 shows a portion of a double layer sweater with stitched diamond shaped pockets.

Turning now in detail to the drawings, FIGS. 1 and 2 show a series of pockets 10, on a portion of knitted cloth 15 shown in the circle. The pockets 10, are stitched closed using stitching 20, such that the stitching can create any shaped pattern. In the pattern, the pockets are each adjacent to the other in a contiguous manner. Pockets 10 are made up of an inner layer 30 adjacent to the wearer's skin and an outer layer 40 away from the wearer's skin. The inner layer 30 comprises an inside face 32 and an outside face 34. The inside face 32 of the inner layer 30 faces the body of the user, while the outside face 34 of the inner layer 30 faces the inside 36 of a pocket 10 of the sweater. The inner layer 30 is comprised of a hydrophilic yarn to remove the perspiration from the skin of the wearer.

As shown in FIGS. 2 and 2A, the knitted cloth also comprises an outer layer 40 which has an inside face 42 and an outside face 44. The inside face 42 faces into the inside 36 of the pocket 10 of the sweater. The outside face 44 faces the outside air and atmosphere. To keep moisture out from the outside air, the outer layer comprises a hydrophobic material designed to repel rain water and stains. These two layers 30 and 40 when stitched together with stitching 20 form insulating pockets 10, trapping heat from the body of the wearer within the pockets.

FIG. 1 also shows a sweater 50 comprising a series of pockets 10 which are adjacent and contiguous, with the sweater having a collar 52, a left sleeve 54, a right sleeve 56, a left cuff 58 on the left sleeve 54, a right cuff 60 on the right sleeve 56. The sweater also contains a lower 2×1 knit cuff girdle with two bands of elastic portion 62 knit to the bottom portion of the sweater 50 wherein the knitted cuff girdle fits substantially around a user's waist.

Figure 3:
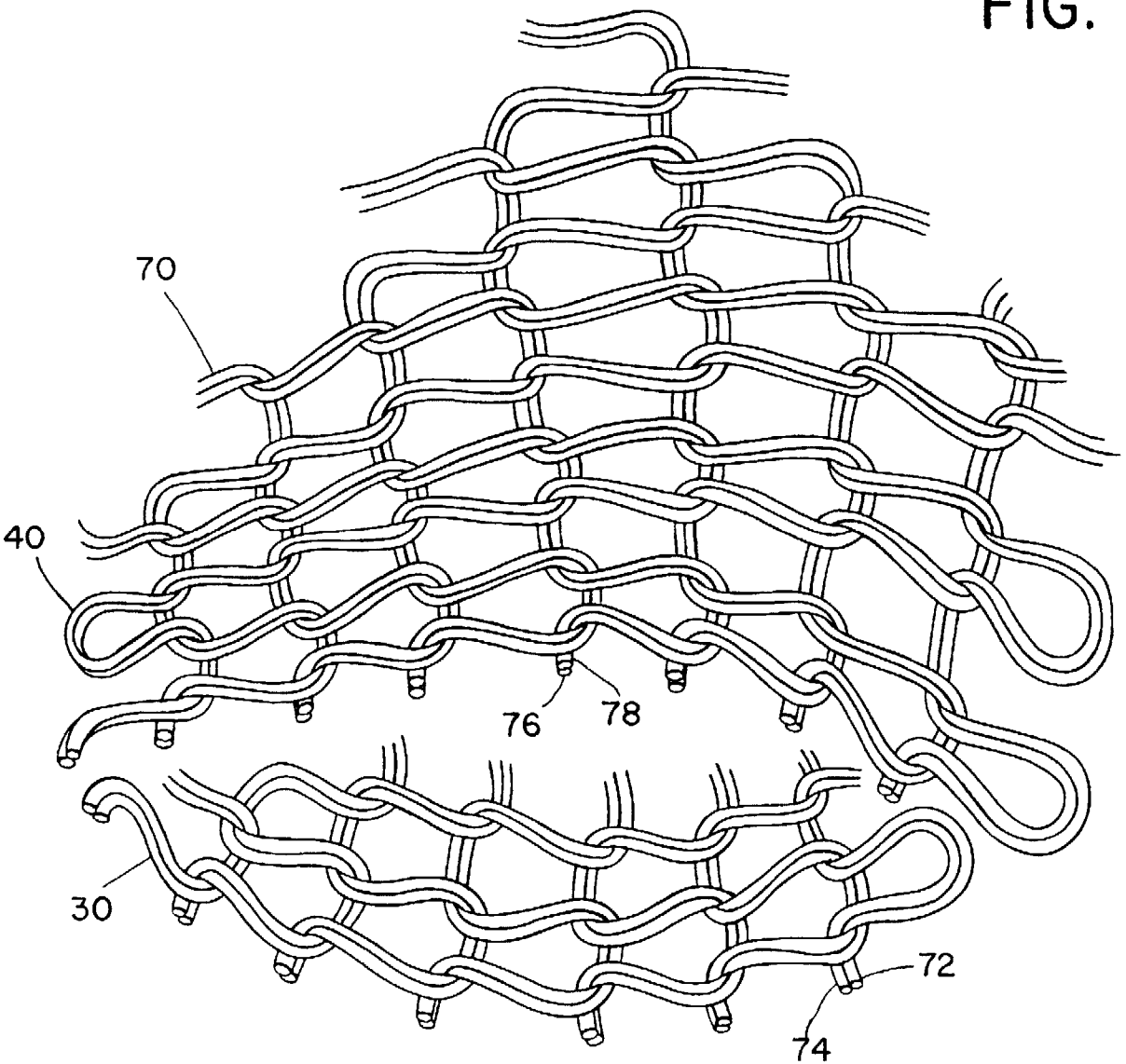
FIG. 3 shows the inter-woven layer having the double yarn fabric used to construct the sweater.

FIG. 3 shows a series of interlocking mesh stitching 70 on both the inner layer 30 and the outer layer 40. The mesh stitching 70 of the inner layer 30 is composed of two yarns which may be the same or may be a different fiber content and construction, with a first yarn first yarn 72, and a second yarn 74, forming the inner layer 30.

The inner layer 30 is composed of hydrophilic yarn.

Yarns 72 and 74 can be a 10/1 count DuPont COOLMAX® semi-dull, Dacron® polyester, tetra-channel yarn that transports moisture/perspiration away from the body. Another type of yarn that can be used is a synthetic polyester or acrylic yarn that has been chemically treated to enhance the hydrophilic or the "wicking" of properties of the yarn.

The outer layer 40 is made up of two yarns 76 and 78 with the yarns 76 and 78 forming an interlocking pattern and comprising a 2/24's count 75% acrylic/25% wool blended high-bulk, 3 denier, 58's grade wool yarn that is hydrophobically treated in a bath of DuPont Teflon®, or any other water/stain repellant hydrophobic treatment. The acrylic material blends with the Teflon® material to create a water/stain repellant hydrophobic exterior layer. The yarn with 75% acrylic content is preferable because acrylic has innate properties that make it hydrophobic which are further enhanced by the Teflon® treatment. The 25% wool content allows for a degree of breathability in the outer layer while maintaining the water/stain repellant hydrophobic properties of the outer layer 40.

Figure 4:
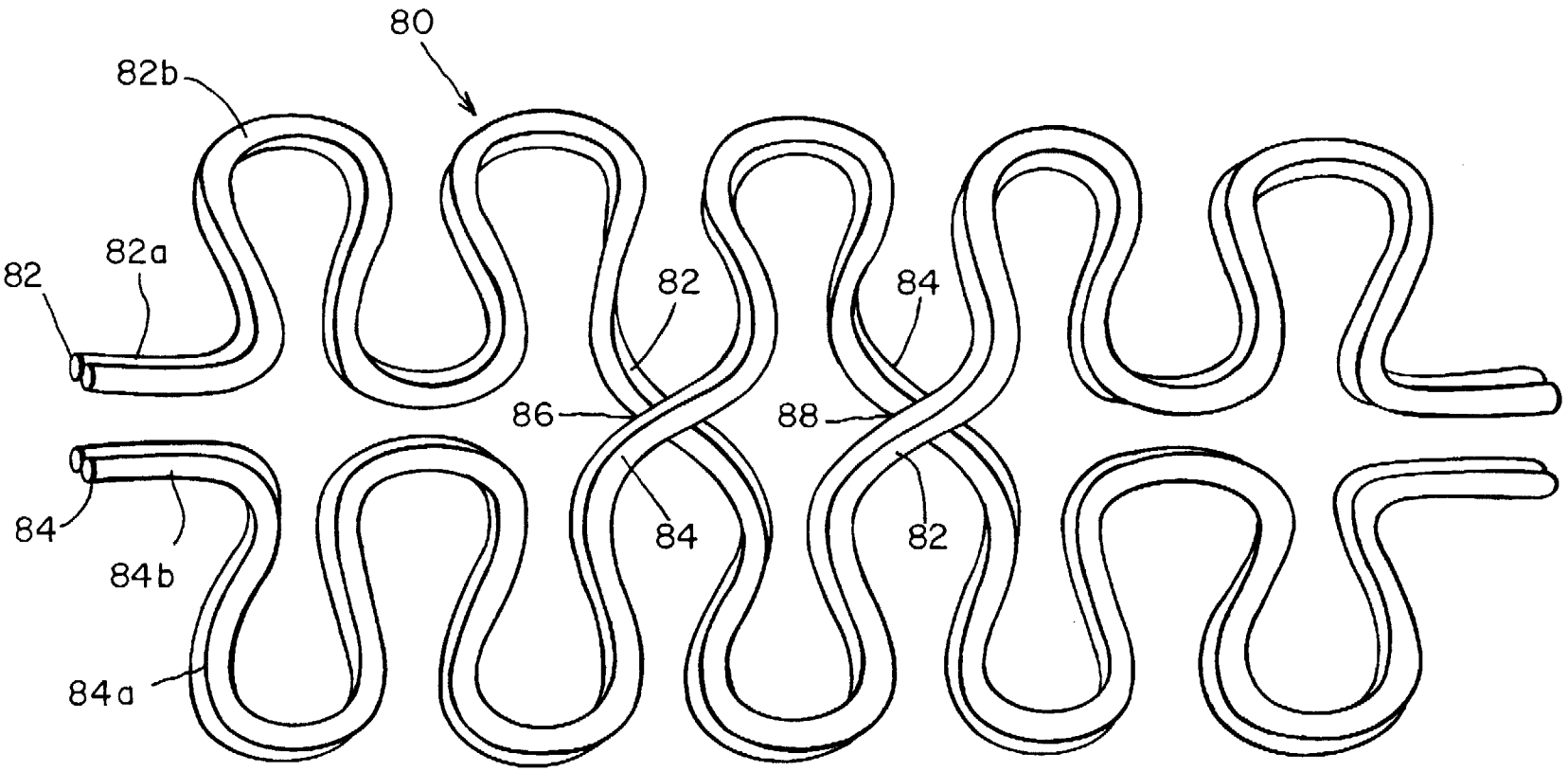
FIG. 4 shows the interwoven strands of yarn used to create the shaped pattern by connecting the upper layer to the lower layer.

FIG. 4 discloses a close up of the interlocking pattern 80 used to create the stitching pattern 20. The pattern 80, consists of two different strands of yarn 82 and 84 for either the inner layer 30 or the outer layer 40.

Strand 82 is composed of two yarn ends **82*a* and 82*b*. Strand 84 is composed of two yarn ends 84*a* and 84*b*. The two strands of yarn are simultaneously fed together to form a pattern wherein the two strands of yarn weave around together over other strands of yarn and cross over each other at points 86 and 88, thus forming the inter-locking pattern. At point 86, strand 84 crosses over strand 82; and at point 88, strand 82 crosses over strand 84**.

The present invention will now be further illustrated by reference to the following Example which is not to be deemed limitative of the present invention.

EXAMPLE

This is an example of the preferred knitting process for producing the multi-layer garment, such as a sweater of the invention. The knitting process simultaneously produces a cloth knit with two yarn ends being fed into the knitting machine to create a double layer of hydrophobic yarn treated with teflon for the exterior layer, and two ends of yarn being fed to create a double layer of yarn with enhanced wicking features for the inner layer. There are therefore four layers used in construction of the garment, namely an exterior layer knit with a double-layer of yarn and an interior layer knit with a double layer of yarn. The cloth can be used to make sweaters, sweater coats, jackets or other outer wear.

The outer layer is constructed of 2 yarn "ends" simultaneously being fed into a 7 gauge (or other gauge) flat (or possibly circular) knitting machine of a known construction to form a double layer of yarn in the outer layer of the cloth. For the knitting machinery, it is possible to use a computerized electronic flat knitting machine, such as the Stoll CMS-440 (Stoll of Port Washington, N.Y.). The yarn used in the outer layer of the cloth is 2/24's count 75% acrylic/ 25% wool blended high-bulk, 3 denier, 58's grade wool yarn that is treated in a bath of DuPont Teflon® (or other water/stain resistant treatment) as it is made to create a water and stain repellant exterior layer. Yarn with 75% acrylic is beneficial because it has innate hydrophobic properties. In addition, these hydrophobic properties are further enhanced when this yarn is coated with a DuPont Teflon@. The 25% wool allows for a degree of breathability in the outer layer while maintaining the water/stain repellant properties.

The inner layer is constructed of 2 yarn "ends" simultaneously being fed into a 7 gauge (or other gauge) flat knitting (or possible circular) knitting machine to form a double layer of yarn in the inner layer of the cloth. The above-mentioned knitting machinery may be used. The yarn used is a 10/1 count DuPont COOLMAX® semi-dull, Dacron® polyester, tetra-channel yarn that transports moisture/perspiration away from the skin of the wearer. The yarn used in the inner layer can also be a synthetic polyester or acrylic yarn that has been chemically treated to enhance the "wicking" properties of the yarn.

The inner layer and outer layer are knit independently and simultaneously joined in a diamond, or other polygonal-shaped pattern to create insulating pockets between the layers that trap body heat to provide additional warmth. This represents a significant improvement in the warmth providing capability of the known knitted garment. There are in effect four layers in this construction. An exterior knit with a double-layer of yarn and an interior knit with a double layer of yarn. By comparison, Toda U.S. Pat. No. 4,733,546, refers to cloth as "multi-layered" being fed with two separate yarns, but there is really only one layer knit from two yarns and there are no independent layers, since the yarns are knit together. The present invention has independent inner and outer layers, simultaneously joined in a quilted pattern and two yarns being used to form each of the two layers. This cloth of the invention is designed to transport moisture/perspiration outward from the skin of the body through the inner layer to the outer layer. This cloth also provides thermal insulation with heat being trapped in the insulating pockets that connect the inner and outer layers and repel water/stains on the exterior layer of the garment to keep the wearer warm, dry and comfortable.

While several embodiments of the present invention have been shown and described, it is to be understood that many changes and modifications may be made thereunto without departing from the spirit and scope of the invention as defined in the appended claims.

What is claimed is:

1. A multi-layer garment to be worn by a person comprising a first layer being an inner layer to be worn adjacent to skin of a person and comprised of a two-yarn knit having two strands of yarn interknit with each other in an interlocking pattern, wherein said inner layer has wickability;

a second layer being an outer layer to be worn away from said person and adjacent to said first layer and comprised of a two-yarn knit having two strands of yarn interknit with each other in an interlocking pattern, wherein said outer layer is made from a wool/acrylic blend yarn for warmth and breathability and said yarn treated with high performance water and stain repellant material to provide a water and stain resistant outer layer;

a series of knit stitches in a shaped pattern for joining said first layer with said second layer, said first layer and said second layer being independent layers; and a series of insulating pockets formed in said multi-layer garment wherein said stitches joins said first layer with said second layer creates said pockets in said shaped pattern such that said pockets trap body heat in the garment to provide a greater warmth for said person.

2. The multi-layer garment of claim 1, wherein said inner layer is made from yarn to quickly wick away perspiration from the skin allowing it to evaporate through the cloth keeping the person wearing the garment dry and comfortable.

3. The multi-layer garment of claim 1, wherein said shaped pattern is that of a polygon.

4. The multi-layer garment of claim 1, wherein said inter-locking pattern is formed by a series of inter-locking loops.

5. A multi-layer garment to be worn by a person comprising a first layer being an inner layer to be worn adjacent to skin of a person and comprised of a two-yarn knit, wherein said inner layer has wickability;

a second layer being an outer layer to be worn away from said person and adjacent to said first layer and comprised of a two-yarn knit, wherein said outer layer is made from a wool/acrylic blend yarn for warmth and breathability and said yarn treated with high performance water and stain repellant material to provide a water and stain resistant outer layer;

a series of knit stitches in a shaped pattern for joining said first layer with said second layer; and a series of insulating pockets formed in said multi-layer garment wherein said stitches joins said first layer with said second layer creates said pockets in said shaped pattern such that said pockets trap body heat in the garment to provide a greater warmth for said person.

6. The multi-layer garment of claim 5, wherein said inner layer is made from yarn to quickly wick away perspiration from the skin allowing it to evaporate through the cloth keeping the person wearing the garment dry and comfortable.

7. The multi-layer garment of claim 5, wherein said shaped pattern is that of a polygon.

8. The multi-layer garment of claim 5, wherein said inter-locking pattern is formed by a series of inter-locking loops.

9. The multi-layer garment of claim 1, which is a sweater.

10. The multi-layer garment of claim 5, which is a sweater.

* * * * *

UNITED STATES PATENT AND TRADEMARK OFFICE

CERTIFICATE OF CORRECTION

PATENT NO. : 5,787,503

DATED : August 4, 1998

INVENTOR(S) : Edward J. Murphy-III

It is certified that error appears in the above-identified patent and that said Letters Patent is hereby corrected as shown below:

Column 3, between lines 29 and 30, insert --FIG. 1A shows an enlarged portion of a part of FIG. 1--.

Column 3, line 48, after "pockets" insert --as shown in FIG. 1A--.

Signed and Sealed this

Twenty-third Day of February, 1999

*Attest:*

Q. TODD DICKINSON

*Attesting Officer*

*Acting Commissioner of Patents and Trademarks*